US008595082B2

(12) United States Patent
Skutta

(10) Patent No.: US 8,595,082 B2
(45) **Date of Patent: *Nov. 26, 2013**

(54) CONSUMER-TO-BUSINESS EXCHANGE MARKETPLACE

(75) Inventor: Brian Edward Skutta, Overland Park, KS (US)

(73) Assignee: AutoTrader.com, Inc., Atlanta, GA (US)

( * ) Notice: Subject to any disclaimer, the term of this patent is extended or adjusted under 35 U.S.C. 154(b) by 5 days.

This patent is subject to a terminal disclaimer.

(21) Appl. No.: 13/291,760

(22) Filed: Nov. 8, 2011

(65) Prior Publication Data

US 2013/0097048 A1 Apr. 18, 2013

Related U.S. Application Data

(63) Continuation-in-part of application No. 13/275,574, filed on Oct. 18, 2011.

(51) Int. Cl.
*G06Q 30/00* (2012.01)

(52) U.S. Cl.
USPC ..... 705/26.1

(58) Field of Classification Search
USPC ..... 705/26.1
See application file for complete search history.

(56) References Cited

U.S. PATENT DOCUMENTS

| | | | |
|---|---|---|---|
| 6,873,969 | B2 | 3/2005 | Stone et al. |
| 7,050,982 | B2 | 5/2006 | Sheinson et al. |
| 7,657,458 | B2 | 2/2010 | Calabria |
| 7,711,603 | B2 | 5/2010 | Vanker et al. |
| 7,840,478 | B1 | 11/2010 | Purpora et al. |
| 7,954,711 | B2 | 6/2011 | Adstedt et al. |
| 7,979,341 | B2 | 7/2011 | Hanifi |
| 8,001,017 | B1 | 8/2011 | Franco |
| 8,005,731 | B1 | 8/2011 | Wolfe et al. |
| 8,015,081 | B1 | 9/2011 | Franco |
| 8,024,230 | B2 | 9/2011 | Zeinfeld et al. |
| 8,082,183 | B2 | 12/2011 | Chowdhary et al. |

(Continued)

FOREIGN PATENT DOCUMENTS

WO 0171458 A2 9/2001

OTHER PUBLICATIONS

"Manheim Auctions' unique new Seller Advance improves part exchange valuation accuracy and dealer cash flow." Manheim Auctions & Remarketing Press Release dated Jul. 9, 2009. (2 pgs.).

(Continued)

*Primary Examiner* — Mila Airapetian
(74) *Attorney, Agent, or Firm* — Sutherland Asbill & Brennan LLP

(57) ABSTRACT

Systems and methods for implementing an item exchange service are usable to aid users in exchanging old items for newer items. According to one embodiment, a system can be operable to receive a request to present a vehicle in a marketplace, calculate a base exchange value for the vehicle and provide, to one or more vehicle resellers, marketplace information associated with the vehicle. Additionally, the system may be configured to receive an exchange offer for the vehicle, determine a final exchange value of the vehicle, and provide the final exchange value of the vehicle to a seller of the vehicle. Further, the system may be configured to allow the seller to determine a course of action regarding disposing of the vehicle after conclusion of the exchange marketplace.

19 Claims, 4 Drawing Sheets

(56) References Cited

U.S. PATENT DOCUMENTS

| | | | |
|---|---|---|---|
| 8,095,422 | B2 | 1/2012 | Hallowell et al. |
| 8,103,559 | B2 | 1/2012 | Bhogal et al. |
| 8,117,090 | B2 | 2/2012 | Romero |
| 2002/0082978 | A1 | 6/2002 | Ghouri et al. |
| 2002/0152125 | A1 | 10/2002 | Goedde |
| 2002/0165722 | A1 | 11/2002 | Luddy |
| 2002/0184104 | A1 | 12/2002 | Littman |
| 2002/0194051 | A1 | 12/2002 | Hall et al. |
| 2005/0065853 | A1 | 3/2005 | Ferreira |
| 2005/0108112 | A1 | 5/2005 | Ellenson et al. |
| 2005/0177387 | A1 | 8/2005 | Mojsa |
| 2006/0080210 | A1 | 4/2006 | Mourad et al. |
| 2006/0085283 | A1 | 4/2006 | Griffiths |
| 2007/0244797 | A1 | 10/2007 | Hinson et al. |
| 2007/0250327 | A1 | 10/2007 | Hedy |
| 2007/0250396 | A1 | 10/2007 | Hallowell et al. |
| 2008/0154669 | A1 | 6/2008 | Eldred |
| 2008/0172344 | A1 | 7/2008 | Eager |
| 2008/0255887 | A1* | 10/2008 | Gruter ..... 705/4 |
| 2009/0070228 | A1 | 3/2009 | Ronen |
| 2009/0070232 | A1 | 3/2009 | Milton |
| 2009/0187513 | A1 | 7/2009 | Noy et al. |
| 2009/0287596 | A1 | 11/2009 | Torrenegra |
| 2010/0030578 | A1 | 2/2010 | Siddique et al. |
| 2010/0063892 | A1 | 3/2010 | Keronen et al. |
| 2010/0082451 | A1 | 4/2010 | Bryson |
| 2010/0088158 | A1 | 4/2010 | Pollack |
| 2010/0100492 | A1 | 4/2010 | Law et al. |
| 2010/0250424 | A1 | 9/2010 | Torres |
| 2011/0035329 | A1 | 2/2011 | Delli et al. |
| 2011/0082759 | A1 | 4/2011 | Swinson et al. |
| 2011/0119158 | A1 | 5/2011 | Gladstone |
| 2011/0125605 | A1 | 5/2011 | Chatter et al. |
| 2011/0161197 | A1 | 6/2011 | Noy et al. |
| 2011/0161202 | A1 | 6/2011 | Arunachalan |
| 2011/0178885 | A1 | 7/2011 | Xiong |
| 2011/0264552 | A1 | 10/2011 | Seergy et al. |
| 2011/0295722 | A1 | 12/2011 | Resiman |
| 2011/0307296 | A1 | 12/2011 | Hall et al. |
| 2012/0036033 | A1 | 2/2012 | Seergy et al. |

OTHER PUBLICATIONS

Final Office Action for U.S. Appl. No. 13/275,574 mailed Feb. 26, 2013.

* cited by examiner

CONSUMER-TO-BUSINESS EXCHANGE MARKETPLACE

RELATED APPLICATION

This application is a Continuation-In-Part, and claims the benefit of priority, of copending U.S. application Ser. No. 13/275,574, filed on Oct. 18, 2011, the disclosure of which is incorporated herein by reference in its entirety.

BACKGROUND

Selling or exchanging an item, often involves providing item details and/or the item to a business, a buyer, or a reseller. For instance, a consumer who wishes to sell or exchange a used vehicle may provide the vehicle to a private buyer or a brick-and-mortar auto reseller, such as an auto dealer. Based on the condition of the vehicle, the dealer may provide an exchange value or an offer to the seller. If the seller likes the exchange offer, they may accept the offer and exchange or sell the vehicle to the dealer. However, if they do not like the offer, selling or exchanging the vehicle may involve starting the whole process over with one or more subsequent private buyers or dealers. This can be a time consuming and onerous task. As such, finding ways to facilitate item exchanges continues to be a priority.

SUMMARY

Systems, methods, and computer-readable media for facilitating an item exchange service are disclosed herein. In certain embodiments, a system may be configured to receive a request to offer a vehicle in an online marketplace, calculate a base exchange value for the vehicle based at least in part on market information associated with the vehicle, and provide, to one or more vehicle resellers, online marketplace information associated with the vehicle. Additionally, the system may be configured to provide a underwriting based at least in part on the base exchange value, receive an exchange offer for the vehicle, wherein the offer is at least equal to or greater than the calculated base exchange value, determine a final exchange value of the vehicle based at least in part on the received exchange offer for the vehicle, and provide the final exchange value of the vehicle to a seller of the vehicle. Further, the system may be configured to receive, from the seller of the vehicle, an indication of acceptance or rejection of the final exchange value of the vehicle, and either provide the final exchange value to the one or more vehicle resellers when the received indication comprises acceptance of the final exchange value, or provide a redemption query to the user associated with the vehicle when the received indication comprises rejection of the final exchange value.

In some embodiments, a method may be configured for receiving a request to offer an item in an online marketplace, determining a base value for the item based at least in part on market information associated with the item, providing, to an item reseller, online marketplace information associated with the item, and receiving an offer for the item, wherein the offer is at least equal to the base value for the item. Additionally, the method may be configured for determining a final value of the item, providing the final value of the item to a seller of the item, and receiving, from the seller of the item, an indication of acceptance or rejection of the final value of the item.

In certain embodiments, one or more computer-readable media storing computer-executable instructions that, when executed by at least one processor, may configure the at least one processor to perform operations for receiving a request to offer an item in an online marketplace, determining a base value for the item based at least in part on market information, providing online marketplace information associated with the item to one or more item resellers, receiving an offer for the item from the one or more item resellers, the offer at least equal to the determined base value, and determining a final value of the item based at least in part on the received offer.

BRIEF DESCRIPTION OF THE DRAWINGS

The detailed description is set forth with reference to the accompanying figures. In the figures, the left-most digit of a reference number identifies the figure in which the reference number first appears. The use of the same reference numbers in different figures indicates similar or identical items.

DETAILED DESCRIPTION

Overview

Figure 1:
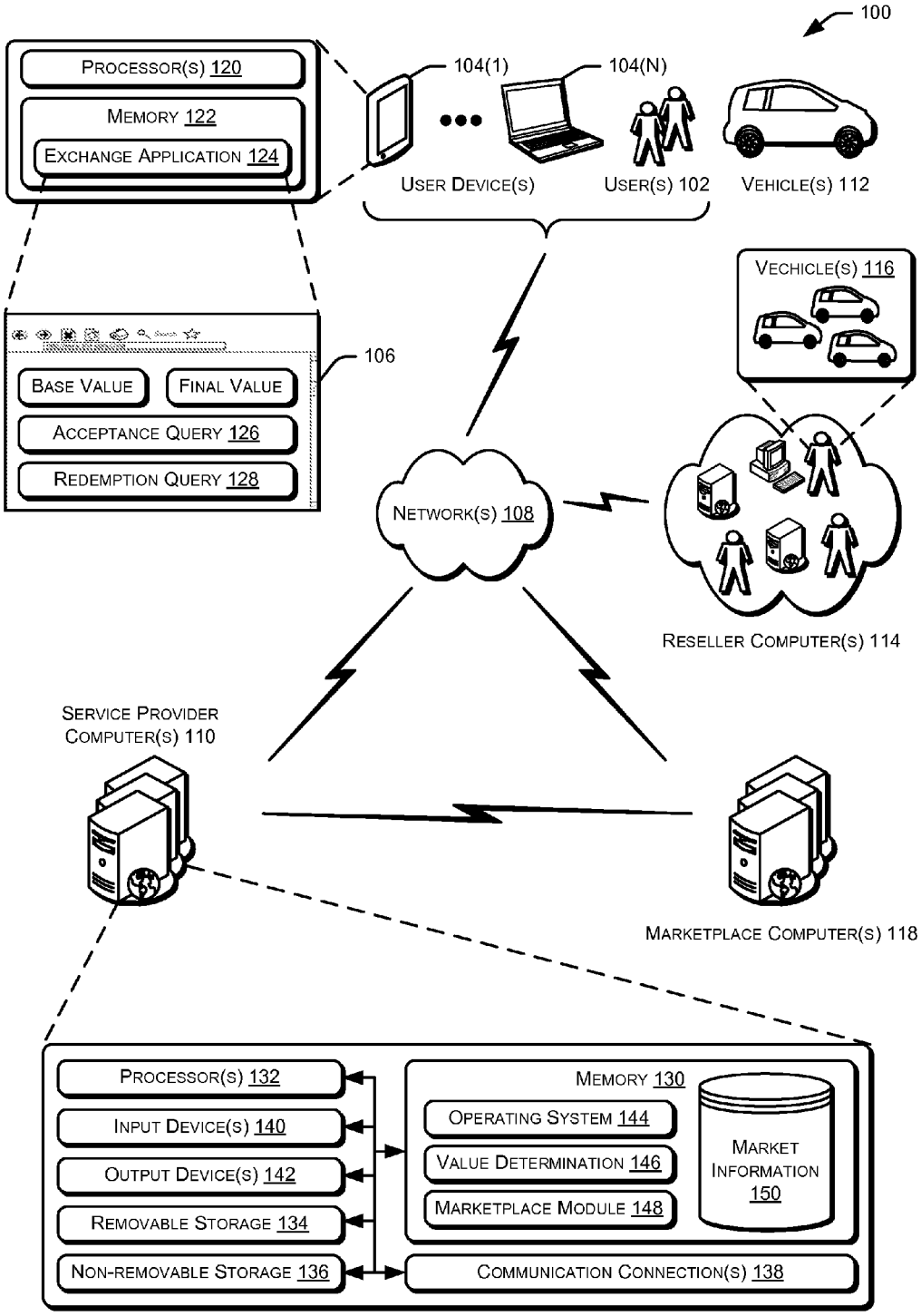
FIG. 1 illustrates an example architecture for implementing an item exchange service, according to one example embodiment of the present disclosure.

Embodiments of the present disclosure are directed to, among other things, providing services to optimize market efficiencies such that a consumer may leverage free market forces to maximize the return on items being sold or exchanged. Additionally, private buyers and/or item resellers may leverage the same free market forces to receive inventory directly from consumers, thus potentially cutting out the middlemen. In some aspects, an exchange may include a direct sale (e.g., an exchange of the item for cash or its equivalent) or a trade (e.g., an exchange of the item, whether new or used, in full or partial satisfaction for another new or used item).

Additionally, in some examples, the services for optimizing such market efficiencies may include item exchange services in the form of live item marketplaces, online item marketplaces, or a combination thereof. As used in this Detailed Description, it should be understood that the word exchange encompasses at least these concepts. In some examples, a marketplace may include an auction-style marketplace or an item exchange service such as, but not limited to, an online auction-style website. In other examples, a marketplace may encompass a bazaar in which the scarcity and desirability of a good may invite a number of purchasers to extend a plurality of competing offers for a given good. Additionally, in some aspects, an auction-style marketplace may include online auction-style listings, online auction-style bidding, and/or online auction-style items exchanges. Similarly, in some aspects, a marketplace bazaar may include an online bazaar, wherein the plurality of competing offers may be placed in a virtual environment over some set period of time.

In some additional examples, a marketplace may include any environment or event such as, but not limited to, a bazaar, a flea market, an online item listing, etc., where consumers may browse through items at their leisure and/or provide purchase or exchange offers to the item providers. In some examples, one or more consumers may make competing offers to the item provider for the same item. The consumers may also continue to outdo one another in an attempt to provide the highest offer at the end of some predetermined time. However, in some examples, an item provider may accept an offer at any time during the marketplace environment or event as opposed to at the end of a predetermined time. For example, once a provider-determined offer price is reached, the item provider may decide to accept the offer price and end the marketplace environment/event for that particular item. In this way, the item provider may control the marketplace duration for an item based at least on a predetermined accepted-price offering and/or marketplace-ending offer price. By way of example only, an accepted-price offering and/or a marketplace-ending offer price may be a specific value of an offer that prompts the item provider to stop competing consumers from making offers and to accept the specific value.

As an overview, items may be any products or services that may be sold or exchanged, for example and without limitation, vehicles, computer products, firearms, articles of clothing, consumer electronics, yard appliances, construction machines and equipment, aircraft, boats, office equipment, furniture, manufacturing equipment, packaging equipment, kitchen equipment, appliances, combinations of the foregoing, or the like, or related products and components. While many of the embodiments of this Detailed Description are described in terms of vehicles, those of skill in the art will understand that the disclosure is not so-limited, and other products, as described herein, could be substituted for vehicles.

Facilitating the selling and/or exchanging of items, for example used vehicles, often involves receiving used vehicles from sellers and providing an amount of money and/or a comparable (or new) vehicle in exchange for the used vehicle. Additionally, implementing an exchange may include determining an exchange value for the used vehicle. In some aspects, the exchange value may be based on the condition of the vehicle, the year, make, and/or model of the vehicle, and/or market conditions, such as real-time market conditions, related to vehicles similar to the used vehicle. By way of example and without limitation, real-time market conditions may include conditions that are determined based on real-time, or near real-time, data. That is, data may be updated continuously over a period of time such as, but not limited to, every second, every minute, every hour, every day, every week, etc., or any appropriate interval based on the context. For example, and as those of skill in the art will understand, different contexts may have different understandings of real-time (e.g., in the new and/or used automobile market, real-time market conditions may imply market conditions that change throughout a day or even a week). In other aspects, however, the exchange value may be determined, like a listing price, by the seller.

In some examples, item sellers may be item owners who wish to sell or exchange their items, or those with the authority to sell or exchange the items for the owners. Additionally, item resellers may be those people or entities that receive items, new or used, in exchange for either money (or its equivalent) or other items. Generally, but not always, the item reseller may intend, or attempt, to resell the item that was received. An online or brick-and-mortar vehicle reseller (e.g., a used and/or new car dealer that may receive vehicles in exchange for money or other vehicles) may provide base exchange values for used vehicles provided by vehicle sellers. Alternatively, or in addition, the base exchange values may be provided by service providers, including online service providers that may facilitate item exchange services or by the vehicle sellers themselves. In some examples, the base exchange value, once determined by the resellers and/or the service providers may be provided to the seller of the used vehicle. Further, in some instances, the seller may provide the vehicle to a dealer for an inspection (e.g., a certified inspection), or a mobile inspection may be conducted at a location of the vehicle, and the base exchange value may be based in part on the results of the inspection. The seller may even leave the vehicle with the reseller, in escrow.

Additionally, the service provider may allow the seller to initiate an exchange marketplace such as, but not limited to, an auction-style marketplace, an auction-style exchange service, bazaar or the like. In some aspects the service provider may also allow the seller to initiate the exchange marketplace with a starting offer at least equal to, or greater than, the base exchange value. In this way, the vehicle seller may choose to receive offers from brick-and-mortar and/or online auto resellers. Once the exchange marketplace ends, the seller may be given the choice to accept or deny the ending marketplace price. In some examples, sellers who elect to deny the ending marketplace price may choose to accept the initial base exchange value. In some other examples, the marketplace may occur over a first period (e.g., 24 hours, 48 hours, etc. from the marketplace start time), while the ending marketplace price may be valid for a second period (e.g., 48 hours, 72 hours, etc. from the marketplace end time). Thus, an indecisive consumer could let the marketplace lapse, but then elect to exchange the vehicle to complete the transaction.

In some aspects, when the vehicle seller accepts the ending marketplace price, the winning price value (i.e., the amount that the top bidder/offeror has agreed to pay) may be provided to the seller and/or the bidder/offeror (e.g., the reseller) that placed the top offer. The seller may then provide the vehicle to the winning bidder/offeror and consummate an exchange with the reseller based on the top exchange price. In some aspects, consummation of the exchange may be requested within a predefined time frame from the end of the marketplace (e.g., 24 hours, 48 hours, 72 hours, etc.). This may help ensure that the market values associated with the vehicle do not change too much. Additionally, upon delivery, an inspection may be requested to ensure that the vehicle's condition matches the seller's assertions. In the event that there is a discrepancy (e.g., the seller claimed that the vehicle was in "excellent" condition; however, the vehicle is only in "good" condition, the seller claimed that the vehicle had 10,000 miles; however, the actual mileage is 100,000, the seller claimed the tires were "new;" however, they were "bald," etc.), the exchange value may be adjusted. In some examples, the recalculation may include reevaluating the market conditions used in the initial base value determination in light of the confirmed vehicle condition. However, in other examples, updated market conditions may be utilized along with the confirmed condition. In this case, the seller may be presented with a new final marketplace value based on the reevaluation and the seller may be give the choice to accept or reject the new value.

However, in some instances, the seller may provide the vehicle to any dealer within a network of participating dealers. In this way, the seller may be able to provide the used vehicle and receive an amount of money and/or a new (or substitute) vehicle from a dealer regardless of the location of the used vehicle and/or the seller, even if the top bidder/offeror is located in an area, city, and/or state different from the seller. For example, a seller and the seller's vehicle may be located in Georgia while a top bidder/offeror may be located in Texas. In this scenario, the seller may be able to drop off the used vehicle at a local dealer in Georgia (assuming the local dealer is a participant in the marketplace/reseller program) and the local dealer may honor the top offer even though it didn't participate in the marketplace.

Further, in some examples, the local dealer may honor the top offer by providing an exchange value, or an amount of money, equal to the top offer. In this way, the seller may become a buyer of a new (or replacement) vehicle from the local dealer and may be able to reduce the purchase price of the new (or replacement) vehicle by the top offer. In some aspects, the local dealer may be given the option to keep the exchanged vehicle for the local dealer's own inventory and provide an amount of money to compensate the top bidder/offeror for not receiving the vehicle. Alternatively, the local dealer may ship the exchanged vehicle to the top bidder/offeror. Further, in some embodiments, a shipping component may be included in the marketplace interface to allow the top bidder/offeror and grounding dealer to coordinate shipping. Either way, in this example, the seller may provide the exchanged vehicle and leave the local dealer with an amount of money, a new or used vehicle, or both.

As desired, the service provider may also offer the ability for dealers and/or resellers to automatically determine which and/or how many vehicles should be maintained in their respective inventories. Additionally, the service provider may determine, based on market information, appropriate vehicles to purchase and at what price, and may also automatically place exchange offers and/or place online sales marketplaces for vehicles won via the exchange marketplace.

Further, in some aspects, a seller may choose to forego the exchange marketplace and instead, or after rejecting the final exchange price, place an advertisement, online or otherwise, to sell the vehicle through more traditional routes or keep the vehicle and not sell or exchange it at all. In this way, the seller may utilize the service provider to determine the base exchange value, and even to provide a final exchange marketplace value; however, the seller may still wish to forego an exchange and sell the vehicle to one or more dealers, resellers, or purchasers, such as over the Internet.

The discussion begins with a section entitled "Illustrative Architecture," which describes non-limiting environments in which a service provider may interact with one or more users, one or more resellers, and/or one or more third-party marketplace computers. The discussion then concludes with a section entitled "Illustrative Processes" and a brief conclusion.

This brief introduction, including section titles and corresponding summaries, is provided for the reader's convenience and is not intended to limit the scope of the claims, nor the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Architecture

FIG. 1 depicts an illustrative architecture 100 in which techniques for an item exchange service may be implemented. In architecture 100, one or more users 102 may utilize computing devices 104(1), . . . , 104(N) to access a client application interface (or website) 106 that may be provided by, created by, or otherwise associated with a service provider via one or more networks 108. In some instances, the computing devices (collectively 104) may be configured to present or otherwise display the client application interface 106 to the one or more users 102. The networks 108 may include any one or a combination of multiple different types of networks, such as cable networks, the Internet, wireless networks, and other private and/or public networks. While the illustrated example represents users 102 accessing the client application interface 106 over the networks 108, the described techniques may equally apply in instances where the users 102 interact with a service provider via a personal computer, over the phone, via a kiosk, or in any other manner. It is also noted that the described techniques may apply in other client/server arrangements (e.g., set top boxes, etc.), as well as in non-client/server arrangements (e.g., locally-stored software applications, etc.).

In some aspects, the client application interface 106 may allow the users 102 to access, receive from, transmit to, or otherwise interact with the service provider via one or more service provider computers 110. In some examples, the client application interface 106 may also allow users to receive, from the service provider computers 110 over the networks 108, information associated with one or more used cars 112 of a user 102, including but not limited to a base value and/or a final value. Through the client application interface 106, the user 102 may provide information associated with a vehicle 112 that the user 102 would like to sell or exchange. Additionally, the user 102 may also initiate an exchange marketplace and/or list an advertisement for the vehicle 112 through the client application interface 106.

The service provider computers 110 may be any type of computing devices, such as but not limited to, mobile, desktop, and/or cloud computing devices, such as servers. In some examples, the service provider computers 110 may be in communication with the user devices 104 via the networks 108, or via other network connections. The service provider computers 110 may include one or more servers, perhaps arranged in a cluster, as a server farm, or as individual servers not associated with one another. These servers may be configured to host a website viewable via the client application interface 106 or any other Web browser accessible by a user 102, such as but not limited to one or more of the user devices 104.

The architecture 100 may also include one or more resellers operating one or more reseller computing devices 114 and/or selling (or reselling) one or more vehicles 116, such as at a used and/or new car lot. The reseller computing devices 114 may also be any type of computing devices, such as but not limited to, mobile, desktop, and/or cloud computing devices, such as servers. In some examples, the reseller computers 114 may be in communication with the service provider computers 110 and/or the user devices 104 via the networks 108, or via other network connections. The reseller computers 114 may include one or more servers, perhaps arranged in a cluster, as a server farm, or as individual servers not associated with one another. These servers may be configured to place offers on exchange marketplaces associated with the vehicle 112 and/or provide market information related to vehicles associated with the vehicle 112. Additionally, in some aspects, the reseller computers 114 may be configured to create and/or provide the marketplace functionality.

The architecture 100 may also include one or more marketplace computers 118. The marketplace computers 118 may also be any type of computing devices, such as but not limited to, mobile, desktop, and/or cloud computing devices, such as servers. In some examples, the marketplace computers 118 may be in communication with the service provider computer 110 via the networks 108, or via other network connections. The marketplace computers 118 may include one or more servers, perhaps arranged in a cluster, as a server farm, or as individual servers not associated with one another. These servers may be configured to host an online marketplace, or a website for implementing a marketplace, viewable via the client application interface 106 or any other Web browser accessible by a user 102, such as but not limited to one or more of the user devices 104. Alternatively, or in addition, in some aspects, the marketplace computers 118 may be an integrated part of the service provider computers 110.

The user devices 104 may be any type of computing devices, including but not limited to desktop personal computers (PCs), laptop PCs, mobile phones, smart phones, personal digital assistants (PDAs), tablets PCs, game consoles, set-top boxes, wearable computers, e-readers, web-enabled TVs, cloud-enabled devices and work stations, and the like. In some instances and as illustrated, each user computing device 104 may be equipped with one or more processors 120 and memory 122 to store applications and data, such as a client application 124 that may display the client application interface 106 and/or enable access to the Web site 106 stored on the service provider computers 110, or elsewhere.

In some aspects, the client application interface 106 may provide a base exchange value and/or a final exchange value or a range of potential exchange values as part of the exchange application 124. Additionally, the range of values may range from a determined wholesale value through a consumer-to-consumer value or from a determined market exchange value through a determined (or estimated) wholesale marketplace value. However, in some instances, the base exchange value may be determined somewhat arbitrarily, like a listing price, by the seller. As noted above, a base exchange value may be determined by the service provider computers 110 and may be based at least in part on market information, including, but not limited to, location, current exchange values, the demand for the particular vehicle 112 at the time of the exchange, etc., and/or on condition, mileage, age, make, features/components, and/or model information associated with the vehicle 112. Additionally, in examples of other items (e.g., used digital cameras) that may be exchanged and/or sold via the client application interface 106, market information may be determined based at least in part on the location of the camera, exchange values in particular locations, demand for the particular camera, condition, number of megapixels, brand, model, and/or other information associated with the camera. Further, one of skill in the art will understand that other factors may be involved for other items that may be exchanged through the services described herein, and that any type of item may be sold and/or exchanged utilizing the disclosed services.

Additionally, in some aspects, the client application interface 106 may also provide an acceptance query 126 and/or a redemption query 128 to a user 102 to determine whether the user 102 is willing to accept the top offer of a marketplace or redeem either the base value or an offer to purchase advertisement, respectively. Alternatively, in some instances, the acceptance query 126 and/or the redemption query 128 may be configured to ask the user 102 whether they wish to post a marketplace listing for the vehicle 112 with a starting offer at least equal to, or greater than, the base value.

In some aspects, one or more servers, perhaps arranged in a cluster or as a server farm, may host the service provider 110. Other server architectures may also be used to host the service provider 110. The service provider computers 110 are capable of handling requests from many users 102 and serving, in response, various base values, final marketplace values, market information, and/or user interfaces that can be rendered at user computing devices 104.

In one illustrative configuration, the service provider computer 110 comprises at least a memory 130 and one or more processing units (or processor(s)) 132. The processor(s) 132 may be implemented as appropriate in hardware, software, firmware, or combinations thereof. Software or firmware implementations of the processor(s) 132 may include computer-executable or machine-executable instructions written in any suitable programming language to perform the various functions described.

Memory 130 may store program instructions that are loadable and executable on the processor(s) 132, as well as data generated during the execution of these programs. Depending on the configuration and type of service provider computer 110, memory 130 may be volatile (such as random access memory (RAM)) and/or non-volatile (such as read-only memory (ROM), flash memory, etc.). The service provider computer 110 or server may also include additional removable storage 134 and/or non-removable storage 136 including, but not limited to, magnetic storage, optical disks, and/or tape storage. The disk drives and their associated computer-readable media may provide non-volatile storage of computer-readable instructions, data structures, program modules, and other data for the computing devices. In some implementations, the memory 130 may include multiple different types of memory, such as static random access memory (SRAM), dynamic random access memory (DRAM), or ROM.

The memory 130, the removable storage 134, and the non-removable storage 136 are all examples of computer-readable storage media. For example, computer-readable storage media may include volatile and non-volatile, removable and non-removable media implemented in any method or technology for storage of information such as computer-readable instructions, data structures, program modules or other data. Memory 130, removable storage 134, and non-removable storage 136 are all examples of computer storage media. Additional types of computer storage media that may be present include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, or any other medium which can be used to store the desired information and which can be accessed by the service provider computer 110 or other computing device. Combinations of the any of the above should also be included within the scope of computer-readable media.

Alternatively, computer-readable communication media may include computer-readable instructions, program modules, or other data transmitted within a data signal, such as a carrier wave, or other transmission. However, as used herein, computer-readable storage media does not include computer-readable communication media.

The service provider computer 110 may also contain communications connection(s) 138 that allow the service provider computer 110 to communicate with a stored database, another computing device or server, user terminals, and/or other devices on a network. The service provider computer 110 may also include input device(s) 140 such as a keyboard, mouse, pen, voice input device, touch input device, etc., and output device(s) 142, such as a display, speakers, printers, etc.

Turning to the contents of the memory 130 in more detail, the memory 130 may include an operating system 144 and one or more application programs or services for implementing the features disclosed herein including a value determination module 146, a marketplace module 148, and/or a market information datastore 150. The value determination module 146 may be configured to receive, store, create, and/or determine a base exchange value or range of values for one or more vehicles 112 of users 102. In some aspects, the seller may be prompted or given the opportunity to select a base exchange value from the range of values. Additionally, the marketplace module 148 may be configured to receive, store, create, determine, and/or manage online marketplaces for selling and/or exchanging used vehicles, such as vehicles 112 of FIG. 1. Further, the market information datastore 150 may be configured to maintain, update, and/or otherwise store market information associated with the vehicles 112. As noted above, in some aspects, the marketplace module 148 may actually be performed by a marketplace computer 118 separate from the service provider computer 110.

In some examples, each reseller operating the one or more reseller computers 114 may participate in a network of resellers that are affiliated, or otherwise associated, with the service provider operating the service provider computers 110. As such, each reseller within the network may guarantee, or underwrite, that they will honor a base exchange value and/or a final marketplace price made through the service provider computer 110. That is, participating resellers may underwrite at least some portion of the base exchange offer. In this way, sellers (i.e., users 102) may provide an appropriate vehicle 112 for exchange at any participating dealer, regardless of the location of the vehicle 112 and/or the location of the top bidder/offeror. Further, in some examples, underwriting may include promising, or otherwise guaranteeing, to honor a the underlying base price, or purchase offer, as redeemable.

In one non-limiting example, a user 102 may wish to provide a vehicle 112 as an exchange towards a purchase of a new car 116 from a reseller operating a reseller computer 114. Using a user device 104, the user 102 may provide, via a Web application or interface 106, information associated with the vehicle 112 such as a combination of factors that may include some of, but are not limited to, year, make, model, color, mileage, general interior condition, general exterior condition, accident information, mechanical condition, maintenance information, location, special features, aftermarket features, and the like. This information may be transmitted over network 108 to a service provider computer 110 for processing.

By way of example only, the service provider computer 110 may determine a base exchange value for the particular vehicle 112. This base exchange value may be determined by collecting and/or analyzing market information and/or condition information associated with the particular vehicle 112. For example, the information received from the user 102 above may be utilized in making this determination. Once determined, the service provider 110 may provide the base value to the user 102. The user 102 may choose to take the vehicle 112 to any participating reseller associated with the service provider 110. For example, each reseller affiliated or otherwise associated with the service provider 110, or within another network of participating resellers, may agree to honor any base value provided by the service provider 110.

Alternatively, the user 102 may choose to initiate a live, in-person or online, marketplace for their vehicle 112. For example, the vehicle 112 may be placed in an exchange marketplace where resellers, whether participating (i.e., affiliated with the service provider 110) or not, may be provided the opportunity to make an offer for the vehicle as an exchange. In some instances, the starting price in the marketplace may be based on, and equal to or greater than, the base value provided by the service provider 110. Additionally, in some examples, the service provider computer 110 may be configured to facilitate the marketplace. However, in other examples, a third-party, for example a service provider that operates the marketplace computers 118, may be configured to facilitate the marketplace. Either way, at the conclusion of the marketplace, a final value (e.g., the top offer at the close of the marketplace) may be provided to the user 102 via the interface 106.

At this stage, in some examples, the user 102 may be given the option to accept the final marketplace value. However, in some instances, as desired, the user 102 may not be given this option. For example, it may be beneficial to require the user 102 to guarantee that they will accept the final value prior to beginning the marketplace. This may help encourage resellers to make offers knowing that their efforts will not be foiled by a non-committal seller. Alternatively, the seller may have to commit to pay a fee (e.g., $50) to list the vehicle in an online marketplace such as, but not limited to, an auction-style bidding service or marketplace bazaar. In yet another alternative, the seller may only be required to pay the marketplace fee if the seller elects not to complete the exchange (or the fee may be refunded to sellers who do complete the exchange). However, if the user 102 is given the option to accept or deny, the service provider 110 may provide the final exchange value to the top bidder/offeror, the user 102, and/or all participating resellers 114. Additionally, in some examples, the service provider computer 110 may utilize the final value in determining subsequent base values. For example, final exchange marketplace information may be included in what is known as market information for purposes of determining base values.

In some examples, if the user 102 decides not to accept the final value determined by the marketplace, the service provider 110 may send a redemption query, such as the redemption query 128 displayed by the interface 106, to the user device 104. The redemption query 128 may provide several redemption choices to the user 102. For example, one redemption choice may be to exchange the vehicle 112 at a participating dealer for the base value. Alternatively, or in addition, a redemption choice may include an offer to purchase an advertisement to sell the vehicle 112 to one or more resellers 114 or other purchasers. For example, the seller may choose to purchase an online and/or print advertisement in an attempt to sell the vehicle 112 at any price.

Figure 2:
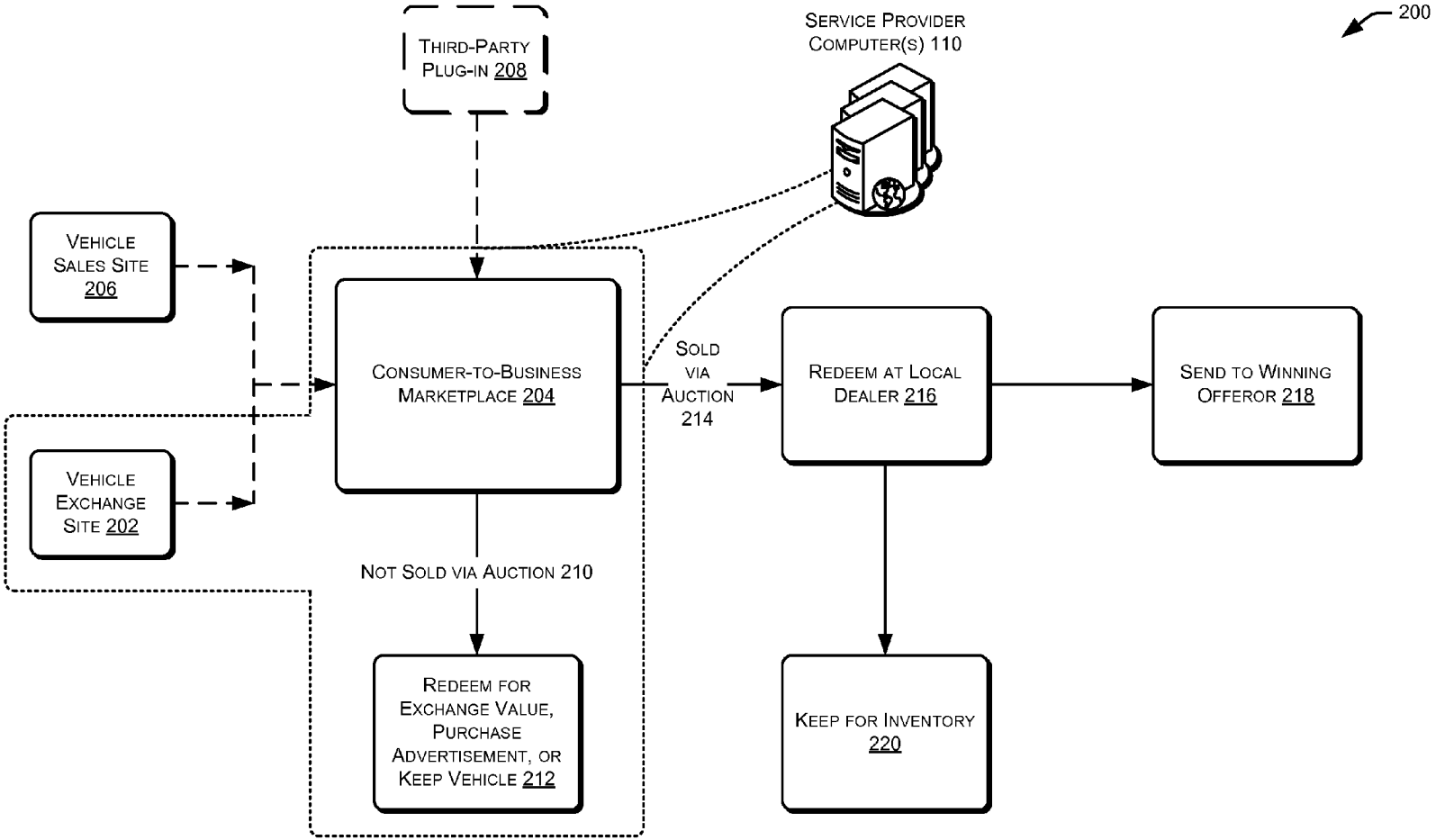
FIG. 2 illustrates another example architecture for implementing an item exchange service, according to one example embodiment of the present disclosure.

FIG. 2 depicts an illustrative architecture 200 in which additional techniques for facilitating an item exchange service may be implemented. In architecture 200, the service provider computer 110 is shown again and, similar to FIG. 1, may be in communication with one or more sellers and/or resellers.

In some examples, as seen by the short-dashed box and lines, the service provider computer 110 may be configured to implement a Web site, such as the vehicle exchange site 202. Additionally, the service provider computer 110 may be configured to implement a consumer-to-business marketplace 204. However, in some examples, a marketplace site, such as the consumer-to-business marketplace 204, an exchange website, such as the vehicle exchange site 202, and/or a valuation service (e.g., a service or site that determines vehicle valuation based on market and/or consumer demand conditions) may be implemented by computers other than service provider computer 110. For example, the one or more marketplace computers 118 of FIG. 1 may perform the consumer-to-business marketplace function 204 on behalf of the service provider computer 110.

In some examples, a seller of a vehicle may opt-in to the consumer-to-business marketplace 204 via the vehicle exchange site 202, a vehicle sales site 206, or a valuation site. By way of example only, a vehicle exchange site 202 may provide vehicle owners a portal for exchanging a vehicle while a vehicle sales site 206 may provide a portal for selling a vehicle and a valuation site may provide pricing and exchange value guidance. Either way, a user may opt-in by selecting a hyperlink or otherwise indicating that they would like to participate in an exchange marketplace. In some aspects, the consumer-to-business marketplace 204 may facilitate implementation of the marketplace. That is, the consumer-to-business marketplace 204 may contact potential bidders (e.g., participating resellers, buyers, wholesalers, etc.), determine and/or set a marketplace start date/time, determine and/or set a marketplace duration or end date/time, determine and/or set a starting bid, and/or provide the results of the marketplace.

As desired, vehicle sellers/exchangers may optionally select exchange marketplace lengths. In some embodiments, the consumer may be able to list any length of time for the duration of the marketplace offering. While in other embodiments, the consumer may be presented with one or more options to choose from (e.g., 24 hours, 48 hours, 72 hours, etc.). Choosing the length of the marketplace offering may be desirable to consumers because they may be able to get a quick look at the exchange value, or they may be able to wait on a longer marketplace offering and potentially drive up the price. Alternatively, the resellers may be interested in a shorter marketplace offering duration because that may signal greater intent from the consumer to commit to the marketplace price. In some aspects, consumers may also be able to commit, in advance, to guarantee that they will exchange the vehicle provided in the marketplace following receipt of the top marketplace offer. This guarantee may entice more resellers to bid during the marketplace offering.

Optionally, a third-party plug-in 208 may be configured to integrate with the consumer-to-business marketplace 204 in order to provide automatic inventory and restocking functionality to resellers. For example, the third-party plug-in 208 may be configured to provide automatic inventory suggestions, profit margin suggestions (e.g., desirable vehicles for a dealer's market, or vehicles that would round out a dealer's inventory), proxy bids based on market conditions and/or predefined settings, etc. Additionally, the optional third-party plug-in 208 may be transparent to the seller such that it aids the resellers in making decisions as well as bidding on exchange vehicles without an indication to the seller.

In some aspects, even after opting-in to the consumer-to-business marketplace 204, the seller may choose not to sell/exchange their vehicle via the marketplace at arrow 210. In this example, the seller may then redeem the vehicle for the base exchange value previously determined, purchase an advertisement to sell or trade the vehicle, or keep the vehicle and exit the marketplace interface and/or system at 212, independent of the marketplace and/or network or resellers associated with the service provider 110. Alternatively, in some aspects, the seller may determine to sell/exchange their vehicle via the marketplace at arrow 214.

For example, the seller may wish to sell or exchange their vehicle based on the final marketplace value (i.e., the highest offer). As such, at block 216, the seller may physically provide their vehicle (in some examples, within a predefined period of time, e.g., 24 to 72 hours) to a local dealer that participates in the network of resellers associated with the service provider 110. The seller may then receive, from the local dealer, an amount of money in exchange for their vehicle or a new (or substitute) vehicle in exchange for their vehicle. In some examples, the local dealer may then send the exchange vehicle to the top bidder/offeror at block 218. As desired, the top bidder/offeror, the service provider 110, the local dealer, or any combination thereof may pay for the shipping and handling. Alternatively, the local dealer may choose to keep the exchange vehicle for their own inventory at block 220. In this example, the local dealer and/or the service provider 110 may compensate the top bidder/offeror for the time and effort taken in making offers in the marketplace and/or based on an estimated profit margin that was expected by the top bidder/offeror or a flat fee provided in the program terms and conditions.

Various instructions, methods and techniques described herein may be considered in the general context of computer-executable instructions, such as program modules, executed by one or more computers or other devices. Generally, program modules include routines, programs, objects, components, data structures, etc. for performing particular tasks or implementing particular abstract data types. These program modules and the like may be executed as native code or may be downloaded and executed, such as in a virtual machine or other just-in-time compilation execution environment. Typically, the functionality of the program modules may be combined or distributed as desired in various embodiments. An implementation of these modules and techniques may be stored on some form of computer-readable storage media.

The example architectures and computing devices shown in FIGS. 1 and 2 are provided by way of example only. Numerous other operating environments, system architectures, and device configurations are possible. Accordingly, embodiments of the present disclosure should not be construed as being limited to any particular operating environment, system architecture, or device configuration.

Illustrative Processes

Figure 3:
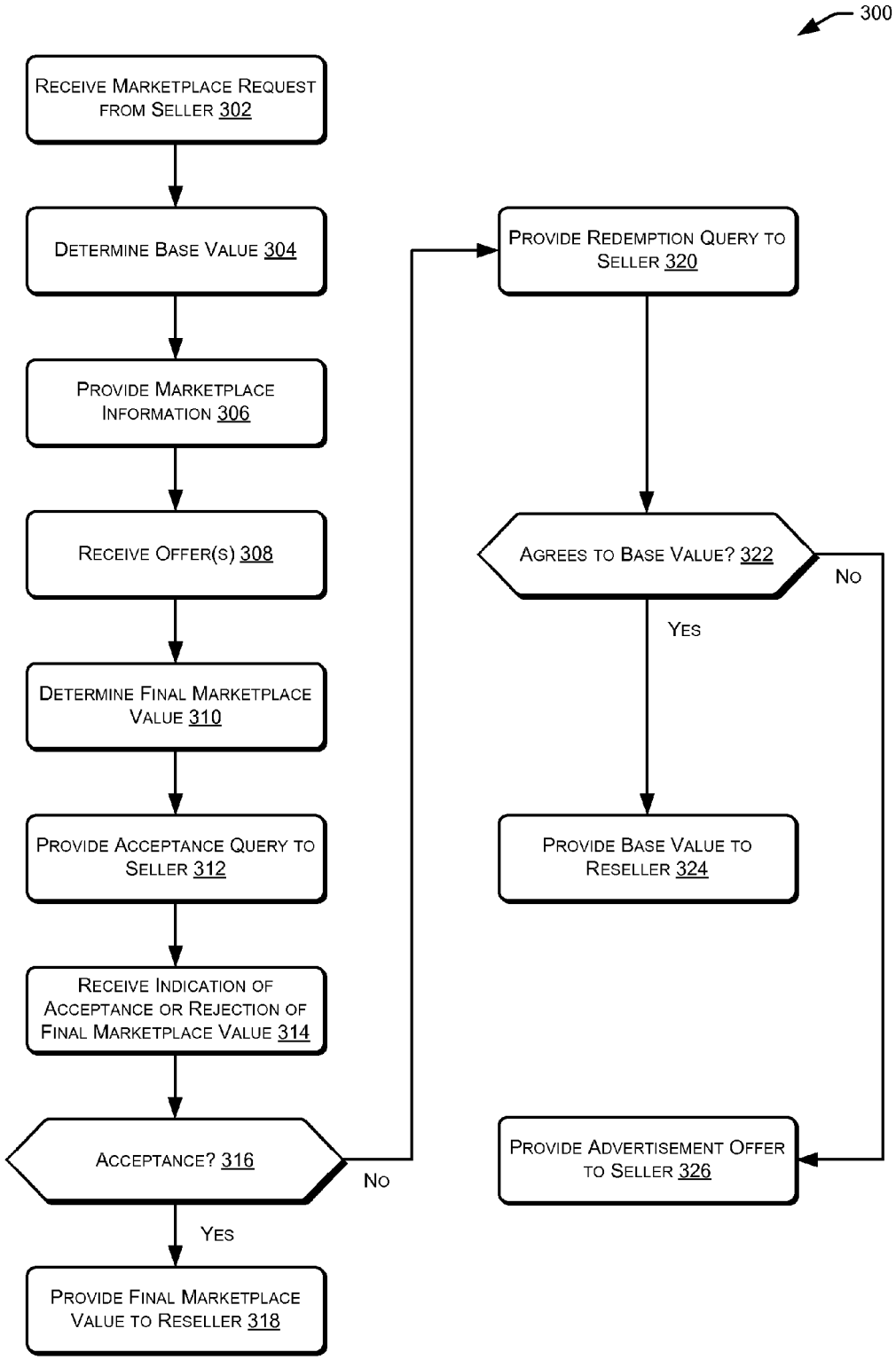
FIGS. 3 and 4 illustrate example flow diagrams of processes for implementing an item exchange service, according to two example embodiments of the present disclosure.
Figure 4:
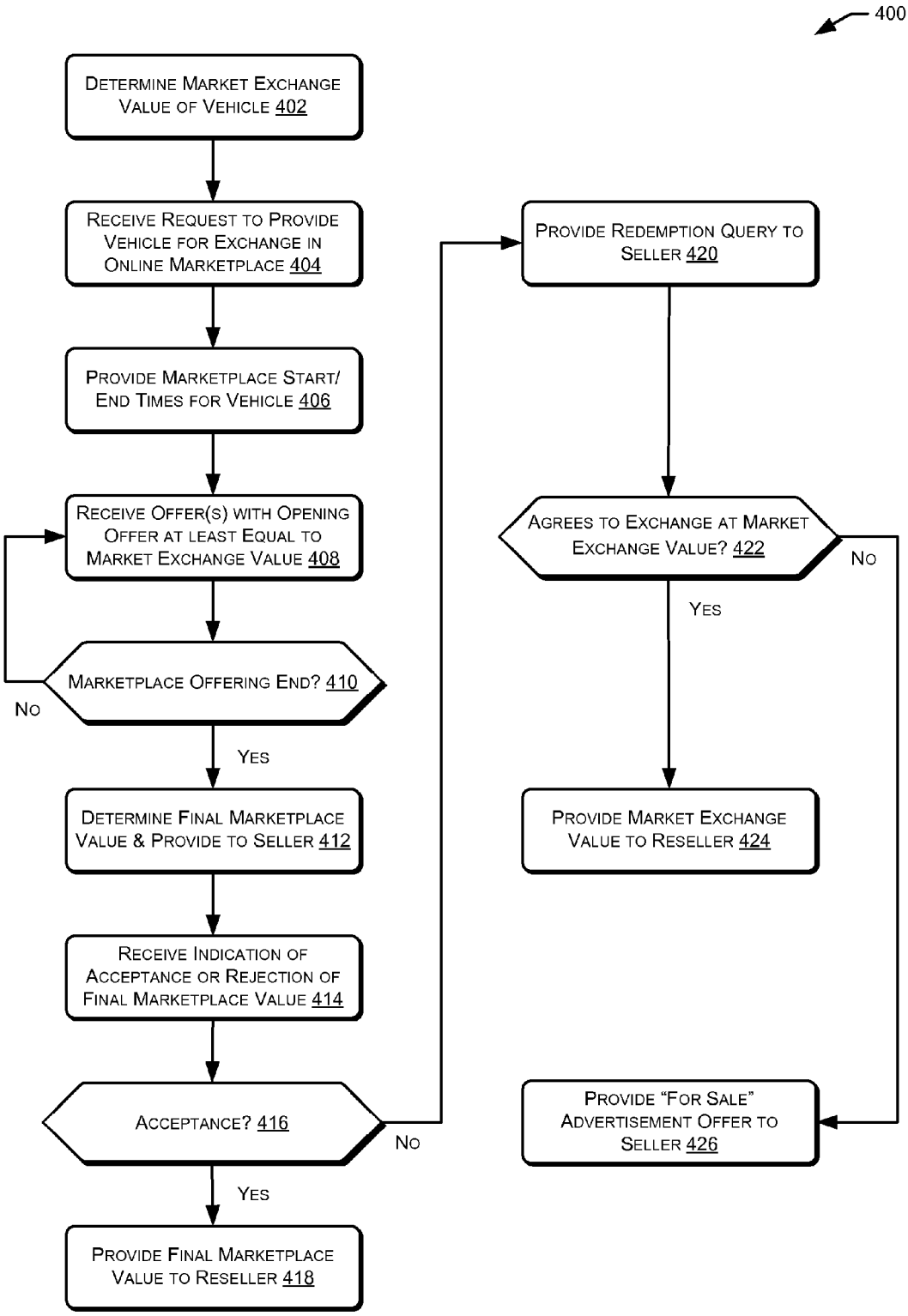

FIGS. 3 and 4 illustrate example flow diagrams showing processes 300 and 400, respectively, for providing an item exchange service. This processes are illustrated as logical flow graphs, each operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the processes.

The process 300 may, but need not, be implemented by a computing device operated by a service provider, such as the service provider computer 110. In some aspects the process 300 may begin by receiving a marketplace request from a seller of an item at block 302. In some aspects, the marketplace request may be received by an input device 140 or via the one or more communication connections 138 of FIG. 1. At block 304, the process 300 may determine a base value for the item that the seller wishes to provide in an online marketplace. In some examples, the base value may be determined based on market information and/or the condition of the item. In one embodiment, the process 300 may utilize a value determination module, such as the value determination module 146 of FIG. 1 for determining the base value of the item.

In some examples, at block 306, the process 300 may provide marketplace information, such as, but not limited to, a start time, a duration, and/or a starting bid. Providing marketplace information may include transmitting the related information by the one or more output devices 142 or via the communication connections 138 of FIG. 1. At block 308, the process 300 may receive one or more bids from purchasers, wholesalers, and/or resellers. Additionally, based at least in part on the top offer during the marketplace offering, the process 300 may then determine a final marketplace value at block 310.

At block 312, the process 300 may provide an acceptance query to the seller. In some examples, the acceptance query may be provided to a user via the one more networks 108 and implemented at a user device, such as one of user devices 104, by an acceptance query module 126 of the user device 104. From the user device 102, in some examples again via the acceptance query module 126 of interface 106, the process 300 may receive an indication of acceptance or rejection of the final marketplace value at block 314. Further, at block 316, the process 300 may determine whether the indication is acceptance or rejection. That is, if the seller is willing to sell or exchange their vehicle for the final marketplace value, the seller will generally accept the final marketplace value. On the other hand, if the seller chooses not to complete the exchange, they may select to reject the final marketplace value.

If the process 300 determines that the seller accepts the final marketplace value at block 316, the process 300 may end by providing the final marketplace value to one or more resellers at block 318. In this way, the network of resellers can be informed of the final marketplace value prior to the seller attempting to redeem the offer. However, if the process 300 determines that the seller does not accept the final marketplace value at block 316, the process may provide a redemption query, such as via the redemption query module 128 of FIG. 1, to the seller at block 320. In some aspects, a redemption query is a request to determine whether the seller, after having rejected the final marketplace value, would prefer to exchange or sell their vehicle for the base value (i.e., redeem the original base-value exchange offer) or purchase an advertisement for offering the vehicle for sale.

At block 322, the process 300 may determine whether the seller agrees to sell or exchange the vehicle to a local dealer at the base value determined at block 304. This determination may be based on a response by the user made through the redemption query module 128 of a user device 104 as seen in FIG. 1. Additionally, in some instances, if the process 300 determines, at block 322, that the seller agrees to exchange or sell the vehicle at the base rate, the process 300 may end by providing the base value to one or more resellers at block 324. Alternatively, in some instances, if the process 300 determines, at block 322, that the seller does not agree to exchange or sell the vehicle at the base rate, the process 300 may end by providing an advertisement offer to the seller at block 326.

FIG. 4 illustrates a flow diagram showing process 400 for providing an item exchange service. The process 400 may, but need not, be implemented by a computing device operated by a service provider, such as the service provider computer 110. In some aspects the process 400 may begin by determining a market exchange value of a vehicle at block 402. In some examples, the market exchange value may be determined based on market information and/or the condition of the vehicle. Additionally, the market exchange value may be used as the base value for the vehicle. In one embodiment, the process 400 may utilize a value determination module, such as the value determination module 146 of FIG. 1 for determining the market exchange value of the vehicle.

At block 404, the process 400 may receive a request, from a seller, to provide the vehicle for exchange in an online marketplace. In some aspects, the marketplace request may be received by an input device 140 or via the one or more communication connections 148 of FIG. 1. In some examples, at block 406, the process 400 may provide marketplace information, such as, but not limited to, a start time, a duration, and/or a starting bid. Providing marketplace information may include transmitting the related information by the one or more output devices 142 or via the communication connections 148 of FIG. 1. At block 408, the process 400 may receive one or more offers from purchasers, wholesalers, and/or resellers. In some examples, the opening offer may at least be equal to the market exchange rate determined at block 402.

At block 410, the process 100 may determine whether the marketplace has ended. In some aspects, the marketplace offering will end once a predetermined amount of time has elapsed. In other aspects, the marketplace offering will end after a certain price is reached or after a certain number of bids have been placed. If, at block 410, the process 400 determines that the marketplace offering has not ended, the process 400 may return to block 408 to receive more bids. However, if the process 400 determines, at block 410, that the marketplace offering has not ended, then the process 400 may determine a final marketplace value and provide the final marketplace value to at least the seller of the vehicle at block 412.

From the user device 102, in some examples via the acceptance query module 126 of interface 106, the process 400 may receive an indication of acceptance or rejection of the final marketplace value at block 414. Further, at block 416, the process 400 may determine whether the indication is acceptance or rejection. That is, if the seller is willing to sell or exchange their vehicle for the final marketplace value, the seller will generally accept the final marketplace value. On the other hand, if the seller chooses not to complete the exchange, they may select to reject the final marketplace value.

If the process 400 determines that the seller accepts the final marketplace value at block 416, the process 400 may end by providing the final marketplace value to one or more resellers at block 418. In this way, the network of resellers can be informed of the final marketplace value. However, if the process 400 determines that the seller does not accept the final marketplace value at block 416, the process may provide a redemption query, such as via the redemption query module 128 of FIG. 1, to the seller at block 420. As noted above, in some aspects, a redemption query is a request to determine whether the seller, sometimes after having rejected the final marketplace value, would prefer to exchange or sell their vehicle (i.e., redeem their original exchange offer at the market exchange value) for the base value or purchase an advertisement for offering the vehicle for sale.

At block 422, the process 400 may determine whether the seller agrees to exchange the vehicle to a local dealer at the market exchange value determined at block 402. This determination may be based on a response by the user made through the redemption query module 128 of a user device 104 as seen in FIG. 1. Additionally, in some instances, if the process 400 determines, at block 422, that the seller agrees to exchange the vehicle at the market exchange rate, the process 400 may end by providing the market exchange value to one or more resellers at block 424. Alternatively, in some instances, if the process 400 determines, at block 422, that the seller does not agree to exchange the vehicle at the market exchange rate, the process 400 may end by providing a "for sale" advertisement offer to the seller at block 426.

Illustrative methods and systems for providing an item exchange service are described above. Some or all of these systems and methods may, but need not, be implemented at least partially by architectures such as those shown in FIGS. 1 and 2 above.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A system, comprising:

at least one memory that stores computer-executable instructions;

at least one processor configured to access the at least one memory, wherein the at least one processor is configured to execute the computer-executable instructions to:

receive a request to present a vehicle in a marketplace;

calculate a base exchange value for the vehicle based at least in part on market information associated with the vehicle;

provide, to a seller of the vehicle, underwriting based at least in part on the base exchange value;

provide, to one or more vehicle resellers, marketplace information associated with the vehicle;

receive an exchange offer for the vehicle, wherein the exchange offer is at least equal to or greater than the calculated base exchange value;

determine a final exchange value of the vehicle based at least in part on the received exchange offer for the vehicle or on an accepted-price offer determined by the item seller;

provide the final exchange value of the vehicle to the seller of the vehicle;

receive, from the seller of the vehicle, an indication of acceptance or rejection of the final exchange value of the vehicle; and provide the final exchange value to the one or more vehicle resellers when the received indication comprises acceptance of the final exchange value; or provide a redemption query to the seller of the vehicle when the received indication comprises rejection of the final exchange value; and provide an offer, to the seller of the vehicle, to purchase an advertisement for selling the vehicle based at least in part on the base exchange value when the response to the redemption query indicates that the seller of the vehicles does not agree to exchange the vehicle to the one or more vehicle resellers for the base exchange value.

2. The system of claim 1, wherein the at least one processor is further configured to execute the computer-executable instructions to:

provide:

the base exchange value, to the one or more vehicle resellers, when the response to the redemption query indicates that the seller of the vehicle agrees to exchange the vehicle to the one or more vehicle resellers for the base exchange value.

3. The system of claim 1, wherein the vehicle comprises a used vehicle and the seller of the vehicle comprises an owner of the used vehicle.

4. The system of claim 1, wherein the calculation of the base exchange value comprises determining a market exchange value based at least in part on at least one of a vehicle identification number (VIN), vehicle sales information for a predefined period, vehicle exchange information for a predefined period, vehicle sales information for a type, class, or condition of the vehicle, or vehicle exchange information for a type, class, or condition of the vehicle.

5. The system of claim 1, wherein the one or more vehicle resellers comprise one or more vehicle dealers participating in a dealer network.

6. The system of claim 1, wherein the marketplace information comprises at least one of a marketplace offering start time or a marketplace offering duration.

7. A method, comprising:

receiving, by at least one network interface, a request to present an item in a marketplace;

determining, by one or more processors configured to execute computer-executable instructions, a base value for the item based at least in part on market information associated with the item;

providing, to a seller of the item by the at least one network interface, underwriting based at least in part on the base value;

providing, to an item reseller by the at least one network interface, marketplace information associated with the item;

receiving an offer for the item, wherein the offer is at least equal to the base value for the item;

determining a final value of the item based at least in part on the received offer for the item;

providing the final value of the item to the seller of the item;

receiving, from the seller of the item, an indication of acceptance or rejection of the final value of the item; and providing, to the item reseller, the final value when the received indication comprises acceptance of the final value; or providing, to the seller of the item, a redemption query when the received indication comprises rejection of the final value; and providing an offer, to the seller of the item, to purchase an advertisement for selling or trading the item based at least in part on the base value when the response to the redemption query indicates that the seller of the item does not agree to sell or exchange the item to the item reseller for the base value.

8. The method of claim 7, further comprising providing an acceptance query to the seller of the item and receiving the indication of acceptance or rejection in response to the acceptance query.

9. The method of claim 7, further comprising:

providing the base value, to the item reseller, when the response to the redemption query indicates that the seller of the item agrees to sell or exchange the item to the item reseller for the base value.

10. The method of claim 7, wherein the request to present the item in a marketplace comprises a request to present a vehicle for an exchange value.

11. The method of claim 10, wherein the marketplace comprises at least one of a live marketplace or an online marketplace.

12. The method of claim 7, wherein the item comprises a used vehicle, and wherein determining a base value for the item comprises determining a market exchange value based at least in part on at least one of a vehicle identification number (VIN), vehicle sales information for a predefined period, vehicle exchange information for a predefined period, vehicle sales information for a type, class, or condition of the used vehicle, or vehicle exchange information for a type, class, or condition of the used vehicle.

13. The method of claim 7, wherein the item reseller participates in a network of item resellers that agree to trade for or buy the item for at least the base price.

14. The method of claim 13, wherein receiving the offer for the item comprises receiving one or more offers from item resellers of the network of item resellers.

15. The method of claim 7, wherein the market information associated with item comprises real-time or near real-time market information associated with the item.

16. The method of claim 7, wherein the final value of the item is based at least part on a highest offer placed during the marketplace or an accepted-price offer determined by the item seller.

17. One or more non-transitory computer-readable media storing computer-executable instructions that, when executed by at least one processor, configure the at least one processor to perform operations comprising:

receiving a request to present an item in a marketplace;

determining a base value for the item based at least in part on market information;

providing underwriting based at least in part on the base exchange value to a seller of the item;

providing marketplace information associated with the item to one or more item resellers;

receiving an offer for the item from the one or more item resellers, the offer at least equal to the determined base value;

determining a final value of the item based at least in part on the received offer providing the final value of the item to the seller of the item;

receiving an indication of acceptance or rejection of the final value of the item from the seller of the item; and providing the final value to the one or more item resellers when the received indication comprises acceptance of the final value; or providing a redemption query to the seller of the item when the received indication comprises rejection of the final value; and providing an offer, to the seller of the item, to purchase an advertisement for the redemption query indicates that the seller of the item does not agree to sell or exchange the item to the one Or more item resellers IBC the base value.

18. The one or more non-transitory computer-readable media of claim 17, wherein the offer for the item comprises an exchange value offer for a used vehicle made by a vehicle dealer associated with a network of vehicle dealers that agree to trade for or buy the used vehicle at least for the base value.

19. The one or more non-transitory computer-readable media of claim 17, wherein the item is a used vehicle owned by a user that provided the request to present the item and the request includes an agreement that the user will liquidate the used vehicle for the base value or the final value.

* * * * *